US009016201B2

(12) United States Patent
Zagar et al.

(10) Patent No.: US 9,016,201 B2
(45) Date of Patent: Apr. 28, 2015

(54) WEB COATING APPLICATOR WITH COOLING AND MATERIAL RECOVERY

(75) Inventors: Steven Zagar, Luxemburg, WI (US); Paul Seidl, Depere, WI (US); Mike Rocheleau, Depere, WI (US); Alain Grandjean, Orleans (FR)

(73) Assignee: MegTec Systems, Inc., DePere, WI (US)

( * ) Notice: Subject to any disclaimer, the term of this patent is extended or adjusted under 35 U.S.C. 154(b) by 726 days.

(21) Appl. No.: 12/449,185

(22) PCT Filed: Mar. 10, 2008

(86) PCT No.: PCT/US2008/003138

§ 371 (c)(1),
(2), (4) Date: Jul. 27, 2009

(87) PCT Pub. No.: WO2008/118284

PCT Pub. Date: Oct. 2, 2008

(65) Prior Publication Data

US 2010/0050670 A1 Mar. 4, 2010

Related U.S. Application Data

(60) Provisional application No. 60/919,802, filed on Mar. 23, 2007.

(51) Int. Cl.
*B41F 23/04* (2006.01)
*B41L 35/14* (2006.01)
(Continued)

(52) U.S. Cl.
CPC ..... *B05C 11/10* (2013.01); *B05C 1/0826* (2013.01); *B41F 23/0479* (2013.01); *B41F 23/02* (2013.01)

(58) Field of Classification Search
CPC ..... B05C 11/021; B05C 1/0826
USPC ..... 62/119, 304; 118/58, 64, 69, 643
See application file for complete search history.

(56) References Cited

U.S. PATENT DOCUMENTS 2,556,262 A 6/1951 Faeber ..... 117/111
2,953,476 A * 9/1960 Armstrong ..... 427/428.13
(Continued)

FOREIGN PATENT DOCUMENTS

DE 3241117 5/1984

OTHER PUBLICATIONS

Chinese Communication dated Sep. 21, 2011 in corresponding foreign patent application No. CN 200880009492.3, 4 pages.
(Continued)

*Primary Examiner* — Steve M Gravini
*Assistant Examiner* — Filip Zec
(74) *Attorney, Agent, or Firm* — Nields, Lemack & Frame, LLC

(57) ABSTRACT

Apparatus and method for applying a water-based emulsion of silicone fluid to a printed web required to be cooled, such that evaporative cooling of the web is promoted in addition to coating of said web with a silicone material. Water evaporated following the application of the silicone fluid to the web is recovered by condensation on the applicator(s) and reapplied to the web, thus economizing the amount of silicone fluid mixture necessary to provide both cooling and enhanced slip characteristics necessary for further handling and processing of the web. The condensation step is effected by containing the evaporated water from the web within a compact enclosure enveloping both the applicator(s) and the web, and optionally chilling said applicator(s) with a cooling medium, preferably water, by means of said cooling medium flowing through at least one of the applicators. In certain embodiments, in addition to condensing the evaporated water, the airborne silicone mist created in the coating step is captured and is returned to the fluid applicator.

5 Claims, 9 Drawing Sheets

(51) Int. Cl.

| | |
|---|---|
| ***F25D 15/00*** | (2006.01) |
| ***F28D 5/00*** | (2006.01) |
| ***B05C 11/00*** | (2006.01) |
| ***B05C 13/00*** | (2006.01) |
| ***B05C 13/02*** | (2006.01) |
| ***B05C 11/10*** | (2006.01) |
| ***B05C 1/08*** | (2006.01) |
| ***B41F 23/02*** | (2006.01) |

(56) References Cited

U.S. PATENT DOCUMENTS

| | | | | | |
|---|---|---|---|---|---|
| 3,565,039 | A | | 2/1971 | Remer | 118/643 |
| 3,923,936 | A | * | 12/1975 | Davis et al. | 264/415 |
| 4,637,341 | A | * | 1/1987 | Switall | 118/694 |
| 5,471,847 | A | | 12/1995 | Murray et al. | 62/91 |
| 5,508,072 | A | * | 4/1996 | Andersen et al. | 428/34.5 |
| 6,082,258 | A | * | 7/2000 | Harrington | 101/148 |
| 6,171,653 | B1 | | 1/2001 | Kohl et al. | 427/377 |
| 6,318,263 | B1 | | 11/2001 | DeVroome | 101/424.1 |
| 6,892,642 | B2 | * | 5/2005 | De Vroome | 101/487 |
| 6,923,121 | B2 | | 8/2005 | DeVroome | 101/488 |
| 6,936,105 | B2 | | 8/2005 | De Vroome | |
| 7,065,901 | B2 | | 6/2006 | de Vroome | |
| 2002/0102355 | A1 | * | 8/2002 | Levendusky et al. | 427/318 |
| 2003/0183099 | A1 | * | 10/2003 | De Vroome | 101/148 |
| 2004/0173149 | A1 | | 9/2004 | DeVroome | 118/694 |
| 2010/0009088 | A1 | * | 1/2010 | Eriksson et al. | 427/428.01 |

OTHER PUBLICATIONS

Australian Communication dated Sep. 12, 2011 in corresponding Australian patent application No. 2008230080.

International Preliminary Examination Report dated Jun. 8, 2010 in corresponding PCT application No. PCT/US08/03138.

Canadian Communication dated Oct. 9, 2012 in corresponding Canadian patent application No. 2,676,814.

Canadian Communication dated Aug. 1, 2013 in corresponding Canadian patent application No. 2,676,814.

European communication mailed Apr. 16, 2014 in corresponding European patent application No. 08742037.8.

* cited by examiner

For simplicity, the full applicator enclosure is shown below on right side of the web – it should be understood for two-side application the apparatus and process is duplicated on both sides of the web. In this case the respective web-to-roller contact areas on each side of the web are offset by 25 to 200 mm in the direction of web travel.

For simplicity, the full applicator enclosure is shown below on right side of the web – it should be understood for two-side application the apparatus and process is duplicated on both sides of the web. In this case the respective web-to-roller contact areas on each side of the web are offset by 25 to 200 mm in the direction of web travel.

WEB COATING APPLICATOR WITH COOLING AND MATERIAL RECOVERY

This application claims priority of U.S. Provisional application Ser. No. 60/919,802 filed Mar. 23, 2007, the disclosure of which is incorporated herein by reference.

FIELD OF THE INVENTION

The present invention relates to apparatus and method for cooling and coating traveling-webs.

BACKGROUND OF THE INVENTION

In web coating, printing and drying operations, it is often desirable that the web have contactless support, in order to avoid damage to the web itself or to the wet coating (such as ink) previously applied to one or more surfaces of the web. One conventional arrangement for contactlessly supporting a web during drying includes horizontal upper and lower sets of air bars between which the web travels. Hot air issuing from the air bars both dries and supports the web as it travels through the dryer.

The hot web subsequently must be cooled. Prior art devices have cooled via conduction or convection which could be either too fast or too slow, causing product quality problems, such as loss of gloss, buildup of ink on web path rollers, or generation of smoke from continued solvent evaporation. Existing methods of mitigating these problems have led to undesirable expenditure in terms of capital cost for additional or larger web cooling equipment, or reduced productivity and efficiency by having to run at slower production speeds. Other prior art devices cool the web primarily via evaporation of liquid, rather than through conduction or convection, thereby allowing moisture availability to the web, which for example in the case of a printed paper web, minimizes web shrinkage, and minimizes static electricity in the web. This can be advantageous, since the paper web, in an offset dryer, is typically dried to less than 2% moisture; and therefore, absorbs water from room air bringing its moisture level back to 4-6%. This absorbance of moisture from room air is slow, taking hours or days as the printed product is typically stacked or wound on rolls, which in this form presents limited surface area exposed to the room air. The addition of moisture may be accomplished more readily by the direct contact to a liquid water source prior to stacking or winding. Such systems are offered commercially by Weko (application by a contact roller) or Eltex (spray application).

Webs printed using the heat set web offset lithographic printing process typically require a slip agent such as silicone oil, such as polydimethylsiloxane (PDMS), to be emulsified in water and applied to the surface of the web prior to winding the printed web into rolls, or more commonly, prior to cutting, folding and stacking into books. This slip agent provides for improved handling characteristics of the printed web to resist scuffing and offsetting (mechanical transfer) of ink from the web surface to path roller surfaces, transfer belts, fold formers, nip rolls and the like, or to the facing page surfaces of a wound web or folded book. The current practice of applying silicone most often requires a prior step, which is the cooling of the web. This cooling step reduces the temperature of the web, which typically exits from the drying oven at temperatures ranging from 120 to 150° C., down to temperatures near room ambient, approximately 25 to 35° C. Application of water-based silicone emulsion is typically conducted after the web has been cooled by conductive contact with a series of cooled rollers (chill rollers). In some cases, silicone is applied while the web is still at elevated temperatures in order to take advantage of evaporative cooling, which is less costly than cooling entirely by conduction to rollers chilled with water. A known advantage of this more recent practice is that it tends to keep the chill rollers as well as the downstream path rollers free of ink deposits. Such a process is disclosed in U.S. Pat. No. 5,471,847. However, this application to a hot web has the disadvantage that the solution applied to the surface loses varying amounts of water to evaporation, depending upon incoming cooling load required owing to web temperature, line speed, and web weight. Consequently, sufficient silicone fluid must be applied to the web in order to achieve the desired amount of evaporative cooling in the most demanding conditions for web cooling, such as high incoming web (dryer exit) temperatures, high web speeds or heavy web weights. This results in consumption of excess silicone concentrate fluid to cool the web, which is costly in terms of silicone material consumed, and may in some cases adversely effect the quality of the printed ink surface causing reduced gloss, fluid streaks, or sticking of pages from excess silicone material applied.

One potential solution to this problem is disclosed in U.S. Patent Publication No. 2004/0173149. It discloses mixing the silicone concentrate and water "on the fly" in response to web conditioning requirements. However, it is difficult in typical press room operations to set up and keep such a system stable during actual production conditions as feedback control means for monitoring the amount of silicone application are not practical, and "recipe" type setups on an a priori basis require testing, adjustment and control plans for each production variation in speed, temperature, web weight and paper type.

The present invention substantially overcomes these and other shortcomings.

SUMMARY OF THE INVENTION

The problems of the prior art have been overcome by the present invention, which provides an apparatus and method for applying a silicone/water emulsion to a web by means of at least one applicator roller having an internal path for flow of coolant, wherein at least a portion of the water from said emulsion applied to said web is evaporated, and is subsequently condensed on said cooled applicator(s) in the immediate vicinity of contact between said web and said roller(s). Additional recovery of said evaporated water may be made in certain embodiments by secondary means of containment, such as enclosing said vicinity of contact within an enclosure or vapor chamber. In some embodiments said enclosure entirely encompasses the at least one cooled applicator and at least a portion of the web path immediately following the applicator. In certain embodiments, the condensed water vapor is returned to the silicone/water reservoir feeding the applicator, and is essentially re-used to maintain the concentration of silicone in the applicator reservoir. In the preferred embodiment, the evaporated water is rapidly condensed in the immediate vicinity of the web-to-roller contact area of the cooled applicator roller(s). Thus, a single concentration of silicone/water mixture may be used, owing to the "self-correcting" nature of the evaporation and subsequent condensation process steps. For instance, if the evaporative heat load of the hot web increases owing to increased incoming temperature, speed, or web weight, more water is evaporated from the silicone emulsion that is applied to the web as taught in the prior art cited. However, with the innovative feature of the present invention in providing a means to capture and condense said evaporated water on the cooled applicator(s), one would not be required to dilute the initial silicone mixture in order to accommodate this higher evaporative cooling load. Thus conditions requiring less evaporative cooling and those requiring more cooling can be handled "passively", that is there is no need to provide sensing and a control system to stabilize the application process to accommodate varying web heat load requirements. Therefore a constant and minimal amount of silicone concentrate may be supplied to the applicator of the present invention and obtain a consistent and optimum level of silicone oil as deposited on the web to enhance further downstream processing.

In certain embodiments, liquid from a supply pan containing, for instance water and silicone oil mixture, is applied to the web, such as a paper web, by at least one applicator roller. Heat from the web evaporates at least a portion of the water and the resulting water vapor is confined to a volume immediately surrounding the at least one applicator roller by means of an enclosure or vapor chamber, the applicator roller being cooled internally by a coolant media, preferably water, to a temperature preferably in the range of 10 to 40° C. to promote recovery of the evaporated water on said applicator roller surface by condensation while avoiding buildup of contaminant material such as ink solids on the roller surface. It is an additional object of the instant invention to reduce and recover silicone mist that is generated by the function of the applicator roller of THE prior art. Such misting is known to occur from the splitting of the liquid film at the location where the web separates from the tangent of the applicator roller surface, forming ligaments of fluid which separate and become airborne. Airborne silicone mist becomes highly problematic to the print room environment as a safety hazard due to creating slippery, walkways, stairs and the like, and also tends to plug certain processing equipment such as afterburners used for pollution control in the heat set drying process. Such ligament formation and separation into mist particles is exacerbated by the evaporation of the water from the silicone emulsion causing it to become more viscous, especially in the case where the web is to be cooled by said silicone emulsion. The condensing function of the cooled applicator of the instant invention serves to eliminate or greatly reduce the tendency to generate mist owing to the direct recovery of water in the immediate location of the film splitting by said cooled applicator roller(s). Such recovery of water by immediate condensation has been observed by the inventors in the applicator-to-web contact area of the cooled applicator roller by measuring water condensation flux rates in the range of 2000 to 6000 kg/hr-$m^2$ and heat transfer coefficients in the range of 10 to 50 kW/$m^2$-° C. Such high transfer coefficients are nearly two orders of magnitude greater than current chill roll heat transfer practice. The flux rates are in the range of those observed in steam condenser exchanger surface design, which points to the mechanism of water transfer to the applicator roller(s) in the instant invention. Further, any mist that may form in the nip area can be recovered, as the mist is confined by the interior surfaces of said vapor chamber and recovered by physical contact on the peripheral wetted surface(s) of said cooled applicator roller(s) and silicone supply pan(s). In certain embodiments, additional cooled rollers within the enclosure provide additional surface area and cooling energy to provide maximum recovery of water vapor and silicone mist. In certain embodiments, moisture is added to the web; that is, additional water that remains with the web after treatment in the applicator device and is not evaporated.

DETAILED DESCRIPTION OF THE INVENTION

Figure 5A:
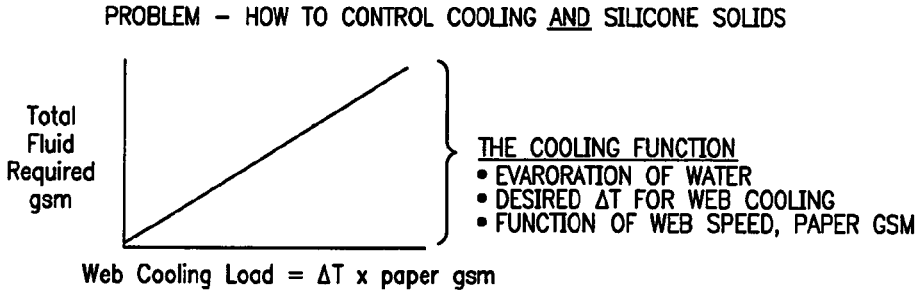
FIGS. 5A and 5B are graphical depictions of the cooling and siliconization functions.
Figure 5B:
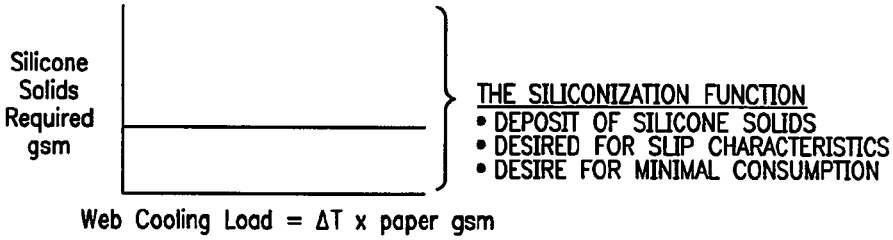

There are two main requirements in the process—that of cooling the web, represented by the top graph in FIG. 5, and that of applying a certain amount of silicone to the surface of the web, represented by the bottom graph in FIG. 5. The cooling requirement varies as a function of temperature and paperweight, while the requirement for silicone solids application is determined by surface properties and is nearly constant for a give type of print production. In order to provide adequate web cooling at high thermal loads (x-axis of the first graph), more fluid is required. On the other hand, the amount of silicone required for surface treatment as a slip agent does not vary with web cooling load (second graph). Consequently, if one performs the first function to meet cooling requirements, either too much or too little silicone material will be applied in the final state for the purpose of surface treatment as a slip agent because a majority of the silicone solids within the initial fluid applied remains on the web, that is, it does not evaporate as is the case with the water. One skilled in the art would then be compelled to operate the process with silicone/water fluid mixture containing sufficient silicone oil concentration to perform the surface treatment as a slip agent when the least amount of total fluid is applied, that is when the minimum cooling (and moisture addition) is required. However, if the cooling load is increased, for instance due to higher incoming web temperature and/or web weight, additional fluid would be required for cooling, bringing with it an excess of silicone oil as compared to that required for acting as a slip agent.

This is wasteful of silicone oil and may actually degrade the quality and appearance of printed materials, as excess silicone solids are known to reduce gloss and cause appearance of streaks in the ink surface. Therefore, it is desirable to apply water according to required cooling load without changing the net amount of silicone solids applied to the final product.

Figure 6:
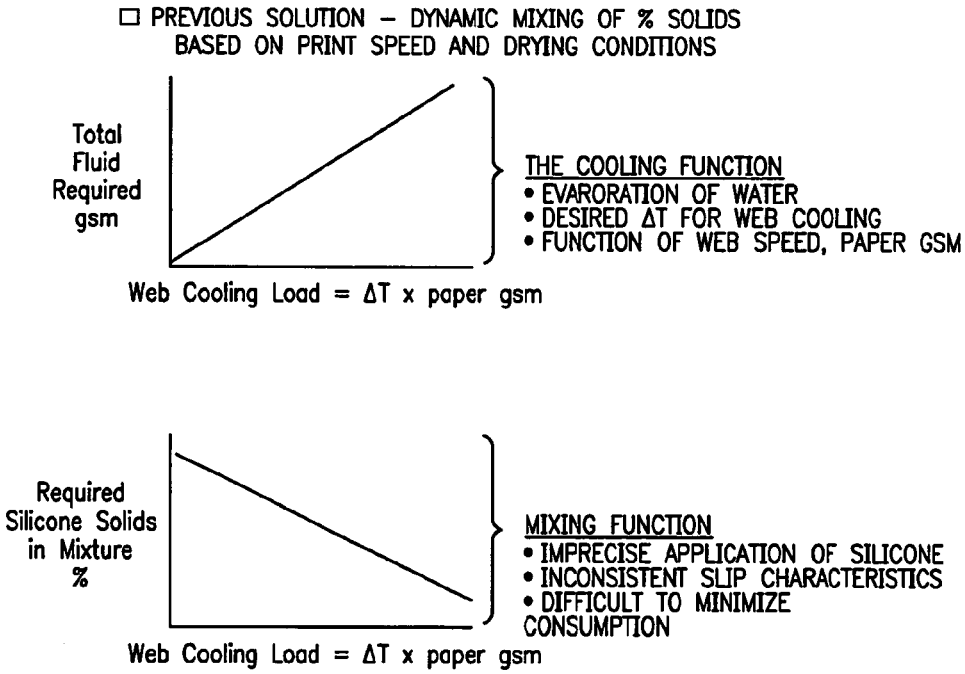
FIG. 6 (PRIOR ART)
FIG. 6 are graphical depictions of prior art solutions to controlling cooling and silicone solids formation.

U.S. Patent Publication No. 2004/0173149 A1 teaches a difficult mixing function to overcome the problem shown in FIG. 5. As cooling requirement increases, along with desired moisture addition, it is the object of this approach to reduce the concentration of silicone oil in the silicone/water mixture such that the net application of silicone solids to the end product is essentially constant. This concept is represented in the graphs of FIG. 6, wherein the first graph is the same as that in FIG. 5, but in this case, a control means is added to reduce silicone content in the fluid mixture as total fluid requirements according to the first graph are increased. That is:

$$\text{total fluid} \times \text{silicone solids concentration} = \text{constant}$$

In practice, this function is difficult to carry out in a stable reliable manner, as it requires additional mixing means, sensor and controls, and/or prescribed recipe formulations for water/silicone mixture for each printing condition of incoming web temperature and web weight anticipated. In practice, operators may still apply some excess silicone in general in order to cover the variations and instabilities lacking in the control hardware and/or control of the mixture formulation.

Figure 7:
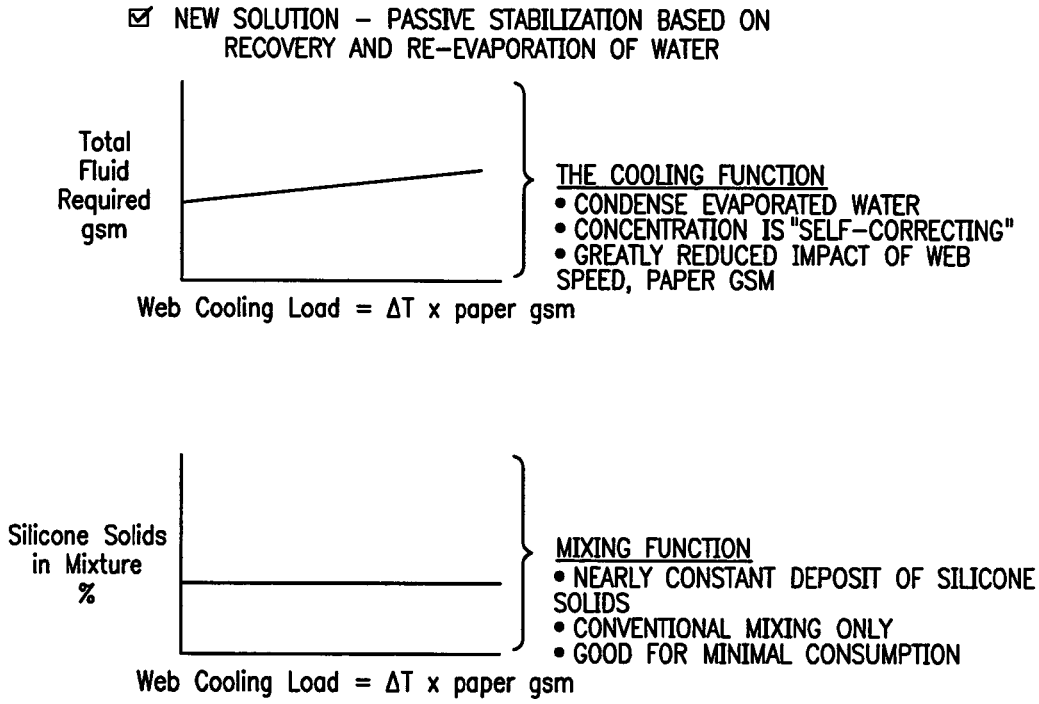
FIG. 7 are graphical depictions of web cooling load versus total fluid required and silicone solids in mixture in accordance with the present invention.

The present invention provides a means of passive response to varying evaporative loads, owing to the recovery of water evaporated by the web. As the cooling load requirement increases, more water must be evaporated as before, but with the means provided of capturing and condensing water vapor, much of the increased cooling requirements are made up by recovered water. Therefore the total fluid required from the initial silicone/water emulsion supply is more nearly constant as shown in the top graph of FIG. 7, versus the top graph of the prior art case in FIG. 6. Consequently, a constant silicone concentration supply mixture can be utilized by operators with very little waste of silicone material and good appearance qualities in the printed product.

Figure 1:
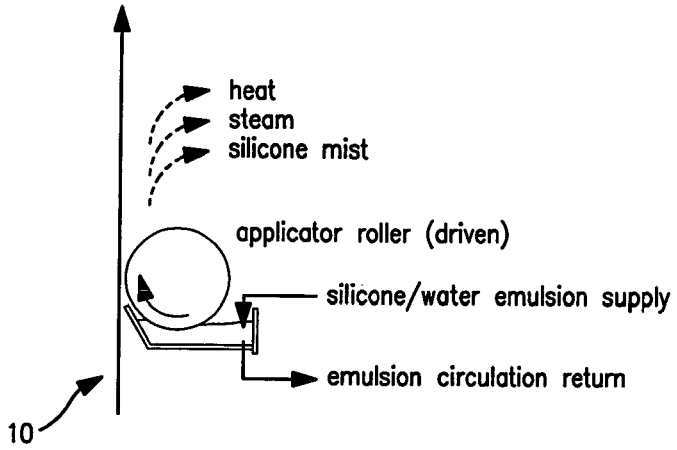
FIG. 1 (PRIOR ART)
FIG. 1 is a schematic view of a conventional silicone/water applicator.

Turning first to FIG. 1, there is shown a conventional applicator for transferring a fluid of a silicone/water mixture to a hot web 10 (the web run could be either upward (as shown), downward or horizontal). (The web 10 is a material web, typically made of paper that has been printed with ink and subsequently dried in a hot air dryer, such as an air flotation dryer.) Heat, steam and silicon mist are generated as the web is cooled by evaporation. The steam and silicone mist are not directly recovered; they are typically released to ambient or are drawn into the dryer (not shown), or a combination thereof. This causes problems due to contamination by condensate and mist, resulting in dripping, material build-up and corrosion, either on surfaces near the applicator in the room, or in the dryer itself. Of particular concern is the ingestion of silicone mist into the dryer where ultimately the exhaust is treated in an afterburner. Such silicone entrapment is a well-known maintenance problem, as it results in build-ups and plugging of heat recovery exchangers used in such afterburners, rendering them incapable of processing the required exhaust flow.

Figure 2:
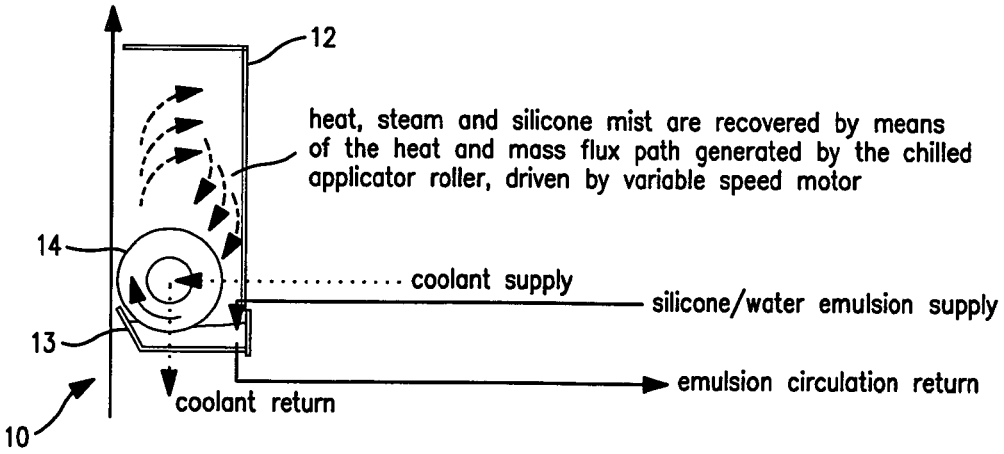
FIG. 2 is a schematic view of silicone/water applicator in accordance with an embodiment of the present invention.

FIG. 2 illustrates an embodiment of the present invention that addresses these problems, such as by capturing the heat, steam and silicone mist within an applicator enclosure 12, and optionally recovering the captured material for re-use. Thus, a silicone/water supply is fed to a containment vessel 13, and an applicator 14 such as a roller is positioned so that a portion of the applicator surface is in contact with the fluid in the vessel 13. The applicator 14 optionally may be cooled such as by supplying a suitable cooling liquid (e.g., water) to the interior of the applicator. This cooling liquid may be recycled through an interior flow path in the applicator and suitable piping. The applicator 14 may also include a surface treatment to enhance wettability, such as a hydrophilic coating applied by flame spray or sputtering processes to metallic surfaces, or to improve resistance to adhesion of ink solids. Suitable coatings are well known to those skilled in the art and are commercially available, such as from Racine Flame Spray, Inc. In a preferred embodiment, a surface treatment of chrome, finished to a very smooth surface, preferably less than 5.0 Ra, most preferably less than 1.0 Ra, is used for sufficient wetting and ink resistance.

As the applicator 14 contacts the silicone/water mixture, a portion of the mixture is carried on the surface of the applicator and is subsequently applied to the web 10 as the applicator 14 rotates. The direction the applicator 14 rotates is not particularly limited; it can rotate either in the direction of web travel or counter to the direction of web travel. One skilled in the art of web handling may prefer a web travel direction, substantially vertical, either in an upward direction, or downward direction in order to best accommodate overall layout of the press line components preceding and following said applicator. For a web traveling in a substantially upward direction, rotation counter to web travel generally allows more silicone/water mixture to be applied to the web per roller revolution than rotation in the direction of web travel. Conversely, for a web traveling in a substantially downward direction, rotation counter to the web travel generally applies less silicone/water mixture to the web per roller revolution than rotation in the direction of travel. The speed of the surface speed of the applicator roller, as set by the speed of rotation of the applicator roller, is much slower than the web speed. The ratio of roller surface speed to web speed is typically in the range of 0.001 to 0.03, though wider ranges are possible. A variable speed motor can be used to drive the applicator 14 to obtain the desired amount of silicone to be applied to the web. In the case of applying silicone simultaneously to both sides of the web, it is also preferred to have independent control of roller speed for each applicator roller to allow operators to control application for more or less silicone to be applied to one side of the web versus the other.

The applicator 14 is preferably completely or substantially enclosed within enclosure 12, so as to contain the steam and water vapor generated upon evaporation from the web. The cooled applicator 14 thus provides a surface or substrate for condensation of the steam and water vapor and carries the condensate and silicone mist back to the vessel 13.

Figure 3A:
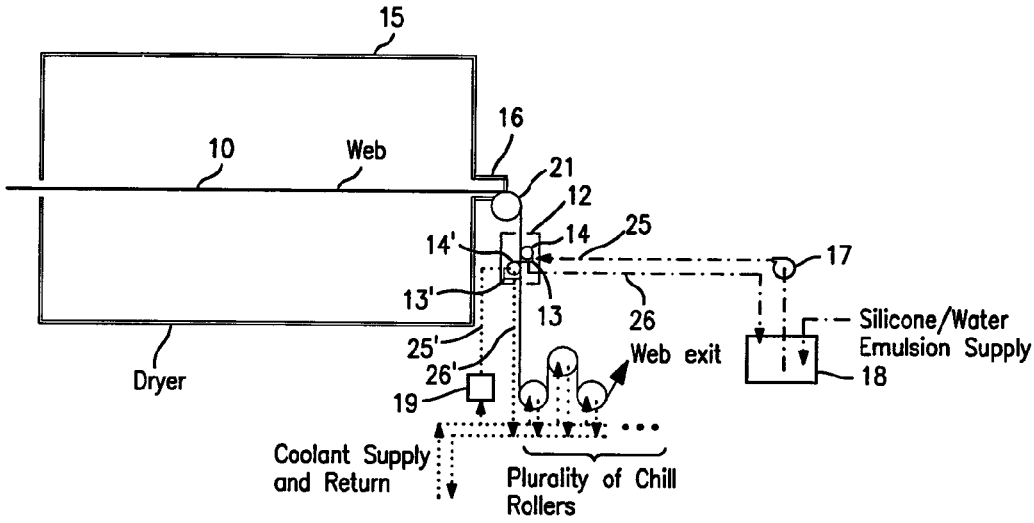
FIG. 3*a* is a schematic view of silicone/applicator shown downstream of a dryer in accordance with an embodiment of the present invention.

FIG. 3*a* illustrates the applicator in a web line arrangement following drying in a single or multi-zone dryer 15. In the embodiment shown, the web path exiting the dryer 15 is directed downward, although the invention is not to be so limited. The atmosphere inside of the dryer 15 is separated from the water vapor and silicone mist generated in the process of applying a silicone/water mixture to cool the web and provide surface treatment to the web (such as a slip agent) firstly by a seal enclosure comprised of a smoke tunnel 16 fitted to dryer exit roller 21, and secondly by the applicator enclosure 12. Primary chill roller 21 can be positioned at the exit of the smoke tunnel 16 (coolant connection and tempering control unit for the primary chill roller 21 not shown) to cool the web. The coolant supply temperature to chill roller 21 is typically in the range of 15 to 50° C., with 20 to 35° C. being the preferred range. In the embodiment shown, two silicone/water applicators 14, 14' are used, each being a roller and communicating with a respective supply vessel 13, 13'. The silicone/water mixture is supplied to the vessels 13, 13' via a circulating system, including a recirculation pump 17 in fluid communication with a sump tank 18 that receives the silicone/water supply from a suitable source. Excess silicone in the vessels 13, 13' can be returned to the sump tank as shown. Applicator rollers 14, 14' receive coolant supply flow through feed lines 25, 25'. Flow of coolant is admitted to rollers 14, 14' through rotary unions. Internal flow passages are provided inside rollers 14, 14' to promote good fluid heat transfer to the cylindrical shells of rollers 14, 14' as is well known to those skilled in the art of chill roll design. Coolant return lines 26, 26' conduct spent coolant back to the main coolant return line. The coolant supply temperature to applicator rollers 14, 14' is typically in the range of 10 to 40° C., with 12 to 25° C. being the preferred range. A plurality of chill rollers can be placed downstream of the applicators to further cool the web. A coolant supply and return, along with a coolant tempering control unit 19, 19' function to supply suitable coolant to each of the rollers as is known in the art.

Figure 3B:
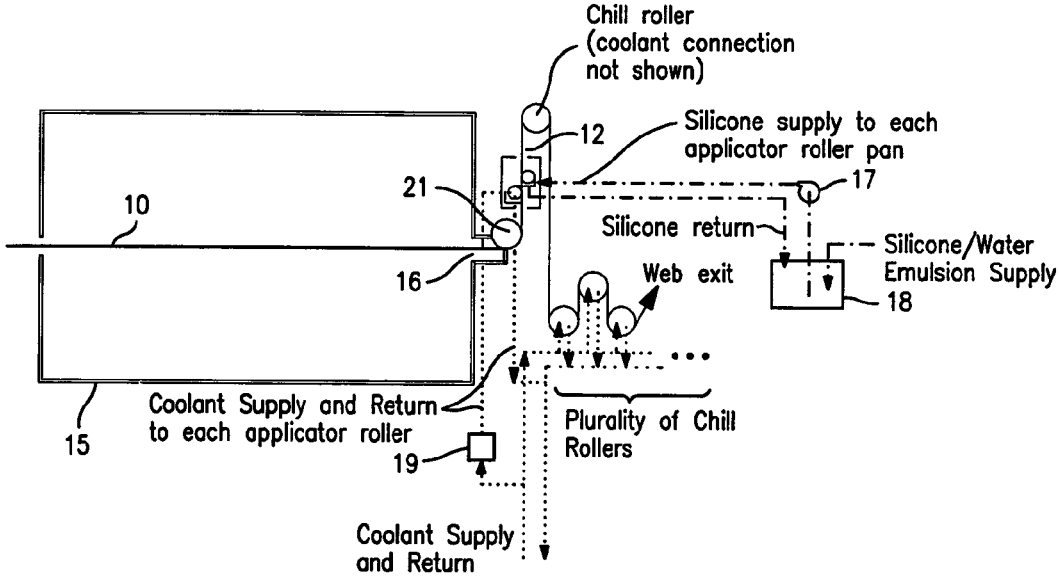
FIG. 3*b* is a schematic view of silicone/applicator shown downstream of a dryer in accordance with an alternative embodiment of the present invention.

FIG. 3*b* illustrates the applicator in a web line arrangement following drying in a single or multi-zone dryer 15 similar to the embodiment of FIG. 3*a*, except that the web path exiting the dryer is directed upward.

Figure 4A:
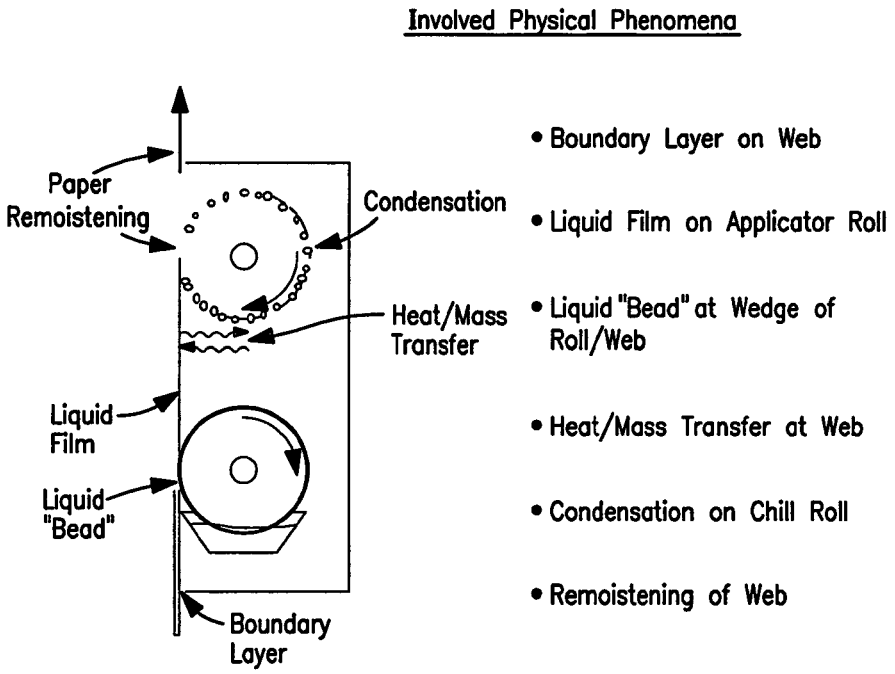
FIG. 4*a* is a diagrammatic view of physical phenomena at the web-to-roll surface.

Accordingly, in the foregoing embodiments, liquid from a supply, containing water and silicone oil mixture, for example, is applied to a web by at least one applicator. Heat from the web evaporates at least a portion of the water and the resulting water vapor is confined to a volume immediately surrounding the at least one applicator by an enclosure. The at least one applicator is cooled internally by a coolant media, preferably water, to a temperature preferably within the range of 10 to 40° C.; with 12 to 25° C. being the preferred range to promote recovery of the evaporated water on the applicator surface by condensation, while avoiding buildup of contaminant material such as ink solids on the applicator surface. Furthermore, silicone mist that is generated by the function of the applicator, as occurs from the splitting of the liquid film at a location where the web separates from the tangent of the applicator roller surface, can be recovered. Mist is confined and recovered by physical contact with condensed water by means of wetting. Additional cooled rollers within the enclosure can be used to provided additional surface area for condensation and cooling energy to provide maximum recovery of water vapor and silicone mist, as illustrated in FIG. 4*a*.

Figure 4B:
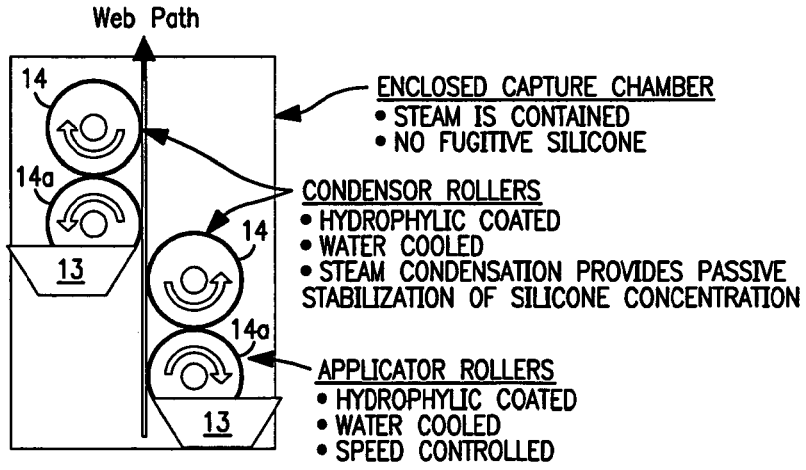
FIG. 4*b* is a diagrammatic view showing applicators on both sides of a traveling web in accordance with an embodiment of the present invention.

FIG. 4*b* shows an embodiment with additional condenser applicators on both sides of the web and within the enclosure or vapor chamber. Pairs of first and second rollers may be in close contact or may be spaced apart to allow greater time for water evaporation from the web within the span between rollers, as is shown in FIG. 4*a*. Silicone fluid, for example, is applied directly to the second applicator 14 by means of liquid film contact with the first applicator 14*a*. As in the embodiment of FIG. 4*a*, both the first and second applicators of each pair are cooled, such as by an internal coolant flow, in order to provide means of recovering water vapor and silicone mist by condensation and wetting phenomena.

Figure 4C:
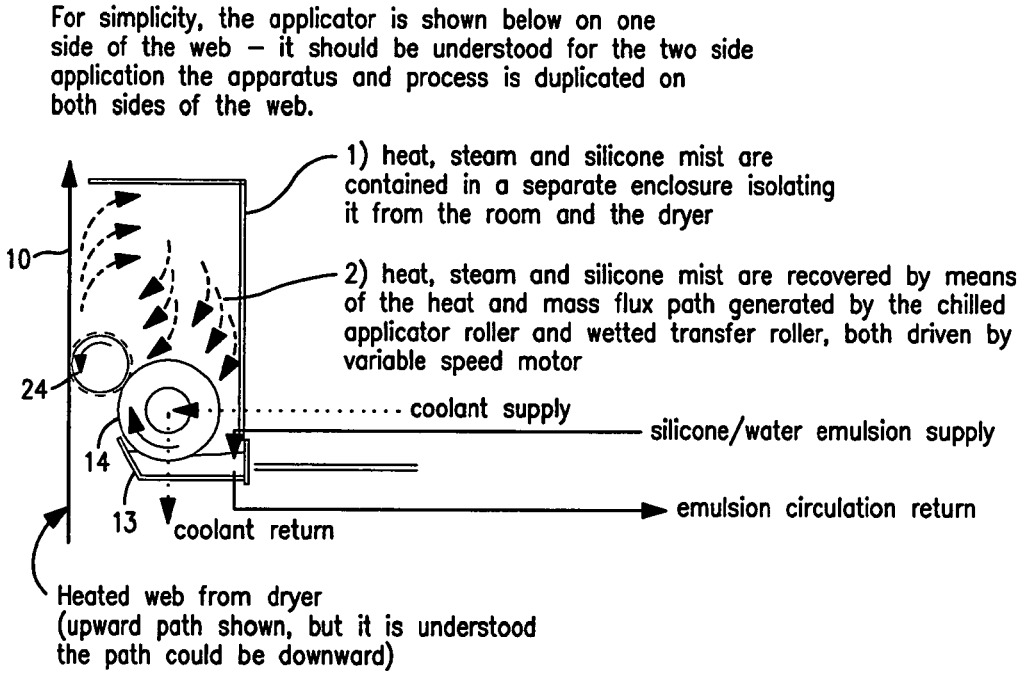
FIG. 4*c* is a schematic view of an applicator including a transfer roller in accordance with an embodiment of the present invention.

FIG. 4*c* illustrates an embodiment wherein a transfer roller for improved cleanability is provided. A cooled pan applicator 14 carries fluid from the pan by means of rotation and transfers the fluid to the transfer roller 24, but does not directly contact the web 10. The fluid carried by the pan applicator 14 is cooled by contact with the applicator surface prior to being transferred to the transfer roller 24. The transfer roller 24 preferably has a surface treatment in order to enhance the amount of fluid carried on its circumference. This treatment is preferably in the form of macro pores or pockets in the surface of the roller 24, such as that applied to an anilox roller. The macro pores carry excess fluid for keeping the roller surface cool while transferring only a portion of the fluid to the web. Thus, the transfer roller 24 effectively has a cooled surface capable of promoting the condensation function of the above-mentioned condenser roller of FIG. 4*b*, but without the need for a flow path of coolant internal to the roller. This transfer roller design allows for simple removal and cleaning of the roller without disconnection of coolant lines and handling the weight of a fluid-filled roller.

Figure 4D:
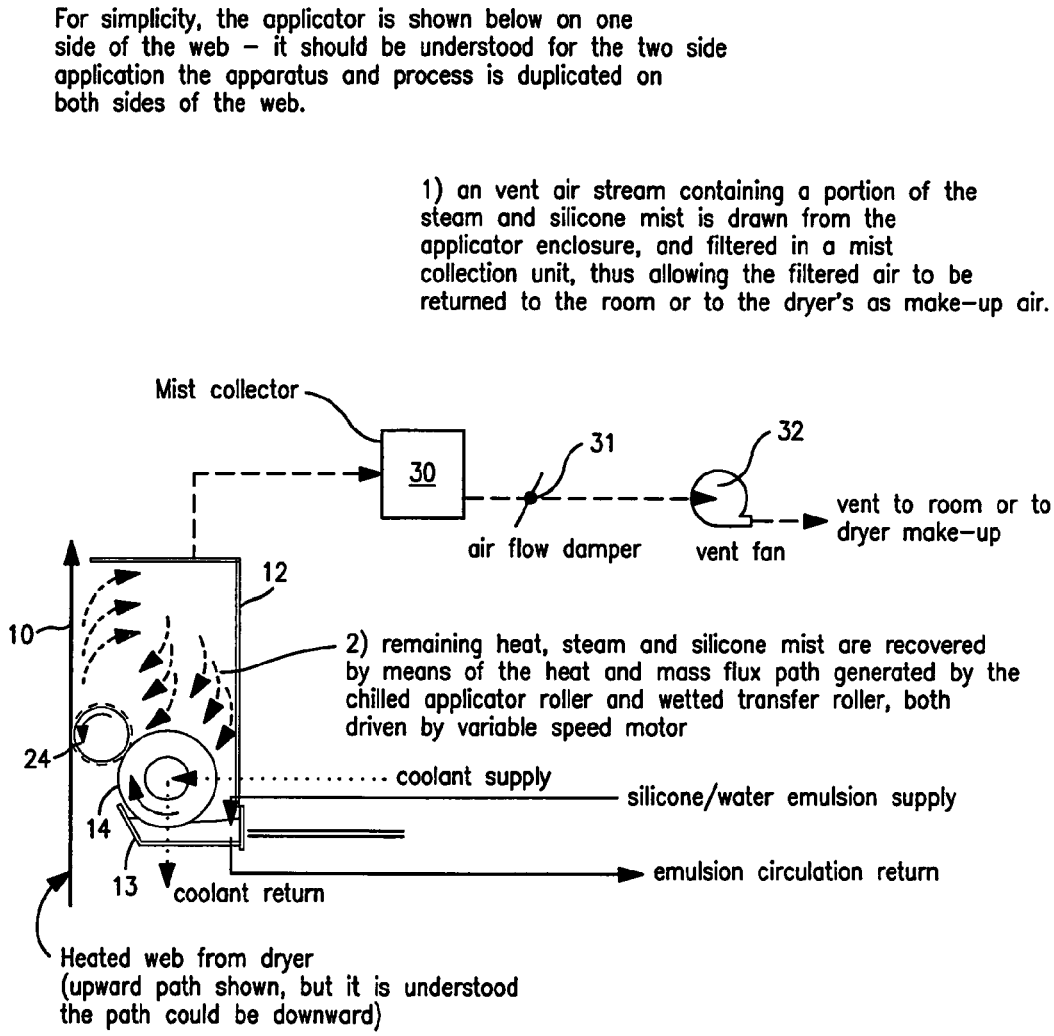
FIG. 4*d* is a schematic view of an applicator enclosure with ventilation in accordance with an embodiment of the present invention.

FIG. 4*d* illustrates an embodiment where ventilation is included in the enclosure 12 that does not directly connect to the room or to the dryer enclosure, but rather includes a mist elimination device, such as the Air King filter device commercially available from Iowa Distributing Inc. of Cedar Rapids. This feature offers additional flexibility in control of moisture recovery and mist collection. At least a portion of the water vapor and silicone mist is removed from the enclosure 12 by withdrawing a regulated airflow from the applicator enclosure 12 and passing that flow through the filtering device 30. The air from the filtering device is then free from harmful contaminants and may be used for make-up air to the room or to the dryer make-up air intake. The airflow can be regulated by an airflow damper 31 and vent fan 32 (or a variable speed blower) to withdraw more or less flow, which as described previously, contains water evaporated from the web 10, thus providing an additional means of moisture regulation independent of the amount of silicone oil that is desired to be applied to the web 10. For example, if it is desired to apply a greater amount of water to the web for either cooling or for the addition of moisture to the paper, without changing the amount of silicone oil applied, less airflow is withdrawn from the applicator enclosure 12, thus causing a greater amount of water to be recovered by condensation on the cooled applicator(s) and subsequently applied to the web. Conversely, if less water is to be applied to the web 10, a greater amount of airflow is withdrawn from the applicator enclosure 12, thereby reducing the amount of water vapor available for condensation on the cooled applicator(s) and condensing roller(s) while the amount of silicone oils applied remains unchanged.

Figure 8A:
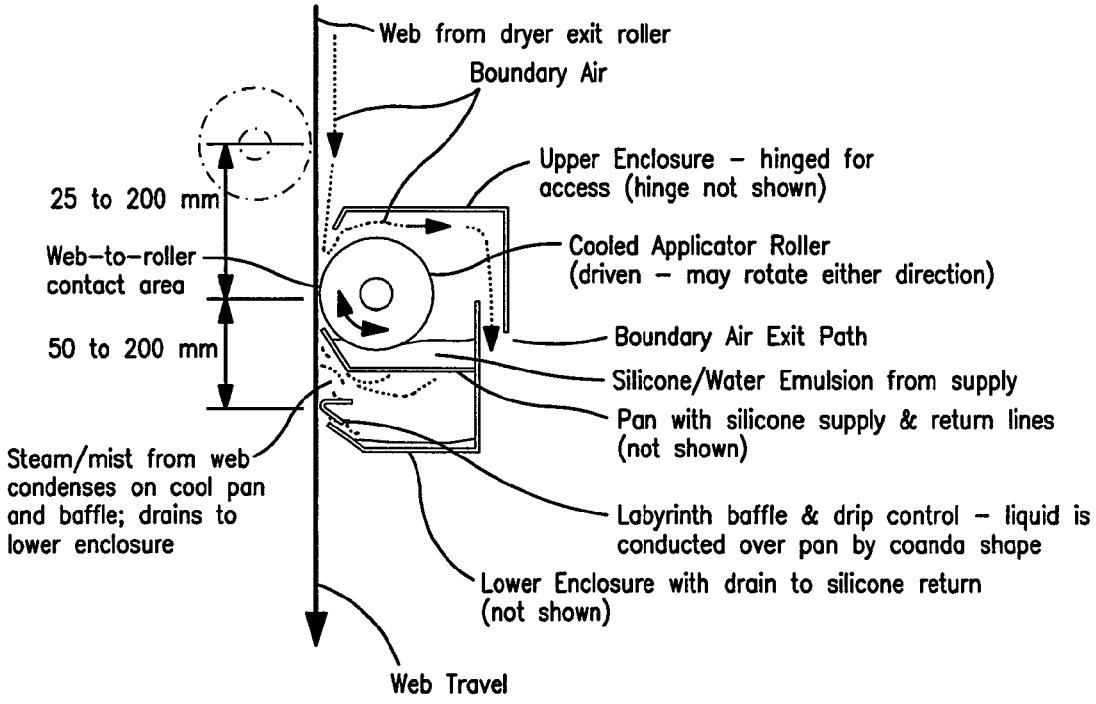
FIG. 8A is schematic view of an applicator enclosure with a downward running web in accordance with the present invention.

As previously described, it is desirable to ventilate the silicone applicator roller enclosure to prevent silicone mist from escaping to the room or into the dryer. Also as described, it desirable to promote rapid recovery of the steam evaporated from the silicone/water in the immediate vicinity of the web-to-roller contact area on the cooled applicator roller surface. FIG. 8A discloses a preferred arrangement for a substantially downward running web, which utilizes the web motion to promote the flow of air in a desired flow path, and also encloses a volume immediately following the roll-to-web contact area, that distance along the web path direction being within 200 mm or less. As is known to those skilled in the art, a boundary layer of air follows a moving surface, such as a web, owing to the viscous properties of the fluid and the shear forces created by the movement of said surface relative to the bulk volume of fluid. As such, the web provides a motive force to impart kinetic energy to said air causing it to flow into the top of the applicator enclosure of FIG. 8A. At the area of web-to-roller contact, said boundary air is prevented from advancing further in the downward direction as the roller effectively acts as a dam to said boundary flow. Without the upper enclosure of FIG. 8A, said flow of boundary air would dissipate into the room, mainly above the roller, and at least a portion of said air, potentially containing silicone mist, may return to the dryer exit web slot with undesirable results described earlier. The upper enclosure of FIG. 8A provides a means of passively (without use of a fan or other additional mechanical device to force the air to move) guiding said air over the roller and directing said air downward beyond the silicone pan to a location below the pan, thus preventing the potential of silicone mist from returning upward to the dryer exit opening. This upper enclosure creates a flow passage to utilize the kinetic energy of the moving boundary layer to passively conduct the air around the roller and silicone pan and down below applicator assembly, away from the dryer exit.

In and immediately below the area of web-to-roller contact, it is desired to maximize the capture steam generated by the evaporation of the water contained in the silicone/water fluid that has just been transferred to the hot web at the contact area. As described earlier, the cooled applicator roller provides as ready surface for the recovery of said steam as water by means of rapid condensation. The lower baffle of FIG. 8A creates a labyrinth-type seal between said baffle and the web, and establishes a volume confined by the web, applicator roller, pan, fluid in the pan, lower enclosure and said baffle. Thus steam generated from the hot web is enclosed and allowed to condense on the cool surface of the pan and said baffle. A secondary pan is positioned under the silicone reservoir pan and said baffle to catch said condensed steam and return it as water to the silicone supply source.

Figure 8B:
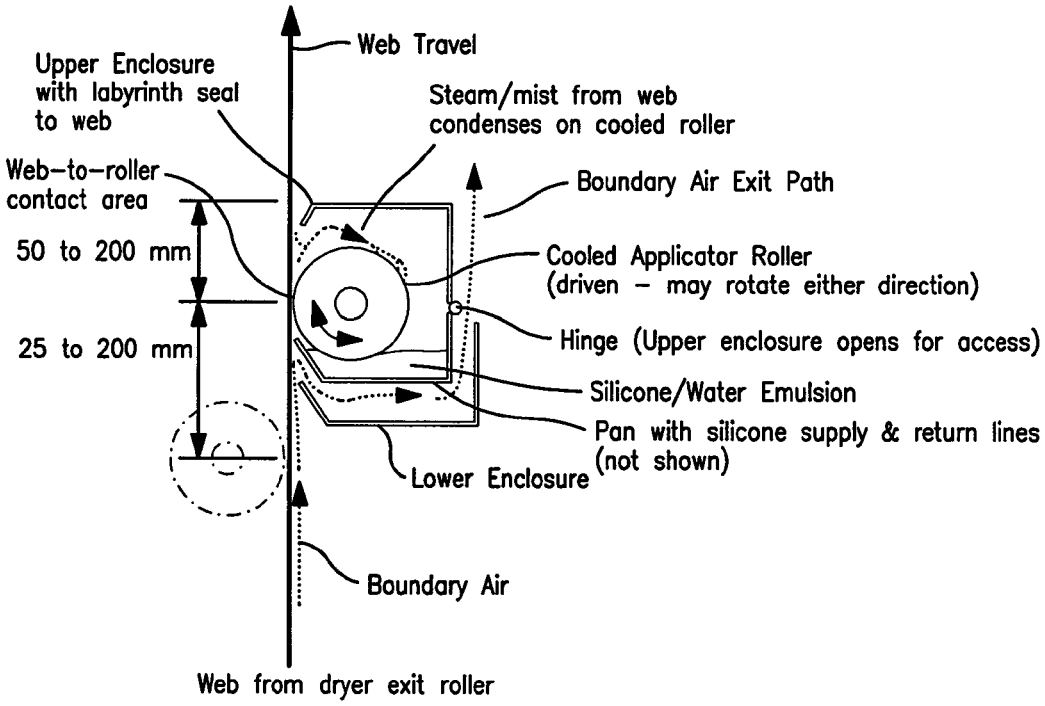
FIG. 8B is a schematic view of an applicator with an upward running web in accordance with the present invention.

FIG. 8*b* shows an embodiment preferred for an upward running web. As before, the moving web carries a boundary layer of air, in this case said web travels upward toward the area of web-to-roller contact. Again, the roller acts as a dam preventing passage of said boundary air past said web-to-roller contact area. To prevent said air from dissipating back toward the exit of the dryer, an outer enclosure creates a flow passage to utilize the kinetic energy of the moving boundary layer to passively conduct the air under and around the silicone pan and above applicator assembly, away from the dryer exit. An upper enclosure provides a labyrinth-type seal between said enclosure and the web, and creates a confined volume bounded by the web, applicator roller, pan, fluid in the pan, and said upper enclosure. Thus steam generated from the hot web is enclosed and allowed to condense on the cool surface of the roller, thus recovering the said steam and returning it to the silicone supply source.

What is claimed is:

1. A method of applying an applicator fluid to a heated web with at least one cooled applicator roller and promoting recovery of evaporated fluid by condensation of said evaporated fluid on the surface of said at least one cooled applicator roller in the immediate vicinity of contact between said heated web and said at least one applicator roller, said web traveling in a web path; said method comprising: providing a supply of applicator fluid comprising silicone and water for application to said web by said cooled applicator roller upon web-to-roller contact; internally cooling said at least one applicator roller with a cooling fluid; enclosing said web path in the extended vicinity of web-to-roller contact of said at least one applicator roller thereby conducting the boundary layer of air and vapor moving with said web to the vicinity of the surface of said at least one cooled roller to promote recovery of evaporated fluid by condensation.

2. Apparatus for cooling a web, said apparatus comprising a supply of an applicator fluid comprising silicone, and an applicator roller transferring said applicator fluid to said web, wherein said applicator roller is internally cooled by a cooling fluid and at least partially enclosed by an enclosure in the proximity of web-to-roller contact such that upon evaporation of said applicator fluid from said web, evaporated fluid remains within said enclosure and condenses on said applicator, wherein the surface of said roller has a smoothness of Ra 5 or less.

3. The apparatus of claim 2, wherein there are a pair of applicator rollers, the first of said pair of rollers contacting said applicator fluid and the second of said pair of rollers contacting said first roller and transferring applicator fluid from said first roller to said web.

4. Apparatus for cooling a web, said apparatus comprising a supply of an applicator fluid comprising silicone, and an applicator roller transferring said applicator fluid to said web, wherein said applicator roller is internally cooled by a cooling fluid and at least partially enclosed by an enclosure in the proximity of web-to-roller contact such that upon evaporation of said applicator fluid from said web, evaporated fluid remains within said enclosure and condenses on said applicator, wherein the surface of said roller has a smoothness of Ra 1 or less.

5. The apparatus of claim 4, wherein there are a pair of applicator rollers, the first of said pair of rollers contacting said applicator fluid and the second of said pair of rollers contacting said first roller and transferring applicator fluid from said first roller to said web.

* * * * *